US011148764B2

(12) United States Patent
Brown et al.

(10) Patent No.: US 11,148,764 B2
(45) Date of Patent: Oct. 19, 2021

(54) WATERCRAFT WITH COLLINEAR FLOTATION ELEMENTS

(71) Applicants: Dennis Brown Lee Brown, Chippewa Falls, WI (US); Sean Clinton Richard Brown, Oakland, CA (US)

(72) Inventors: Dennis Brown Lee Brown, Chippewa Falls, WI (US); Sean Clinton Richard Brown, Oakland, CA (US)

( * ) Notice: Subject to any disclaimer, the term of this patent is extended or adjusted under 35 U.S.C. 154(b) by 76 days.

(21) Appl. No.: 16/746,911

(22) Filed: Jan. 19, 2020

(65) Prior Publication Data

US 2021/0221478 A1 Jul. 22, 2021

(51) Int. Cl.

| | |
|---|---|
| ***B63B 1/14*** | (2006.01) |
| ***B63B 34/50*** | (2020.01) |
| ***B63B 5/24*** | (2006.01) |
| ***B63H 16/20*** | (2006.01) |

(52) U.S. Cl.

CPC ..... *B63B 34/50* (2020.02); *B63B 1/14* (2013.01); *B63B 5/24* (2013.01); *B63H 16/20* (2013.01); *B63B 2005/242* (2013.01); *B63H 2016/207* (2013.01)

(58) Field of Classification Search

CPC ..... B63H 16/20; B63H 2016/202; B63H 2016/205; B63H 2016/207

See application file for complete search history.

(56) References Cited

U.S. PATENT DOCUMENTS

| | | | | |
|---|---|---|---|---|
| 4,496,325 A * | 1/1985 | Tweg | ..... | B63H 16/12 440/26 |
| 4,926,774 A * | 5/1990 | Winner | ..... | B63B 32/51 114/123 |
| 2021/0024174 A1* | 1/2021 | Roche | ..... | B63B 7/04 |

FOREIGN PATENT DOCUMENTS

| | | | | |
|---|---|---|---|---|
| DE | 202012005066 U1 * | 8/2013 | ..... | B63H 16/20 |

* cited by examiner

*Primary Examiner* — Andrew Polay

(57) ABSTRACT

A unique watercraft that includes a plurality of flotation elements which are aligned longitudinally and fit together end to end, comprising the watercraft hull. Unlike other watercraft, it does not rely upon a low center of gravity for stability. A front flotation element pivots about an axis and this pivotal motion is used for both steering and for maintaining balance. The effective profile of the hull changes dynamically as the front flotation element is turned. These hull changes allow the operator to balance and make agile maneuvers. Equilibrium can be easily maintained in this manner when the watercraft is moving forward and when it is otherwise stationary in water. In a preferred embodiment, the watercraft is ridden like a bicycle. Balance is actively maintained by a rider who steers right and left to adjust transverse weight distribution. The riding experience feels similar to operating a conventional bicycle on land.

8 Claims, 7 Drawing Sheets

WATERCRAFT WITH COLLINEAR FLOTATION ELEMENTS

CROSS REFERENCE TO RELATED APPLICATIONS

This application claims the benefit of U.S. provisional patent application No. 62/796,486; submitted Jan. 24, 2019; entitled, Watercraft with Collinear Flotation Components

BACKGROUND OF THE INVENTION

The embodiments and aspects described herein are regarding a watercraft. Conventional watercraft rely on a low center of gravity, with a wide base relative to the height of the load, to avoid capsizing. However, a wide watercraft hull increases water resistance resulting in slower speeds and hampered maneuverability. On small watercraft with narrow hulls, occupants must remain positioned close to the waterline to avoid causing unstable equilibrium, which is restrictive for the occupants. Various watercraft with multiple spaced floats and front or rear steering have been proposed, but these are slow to change course, and water flow is impeded by the configuration of floats and steering elements, resulting in lowered top speeds. Other attempts at watercraft with narrow single hulls and a high center of gravity had no effective way to stay upright, particularly at low speeds. Therefore, there is a need for a different kind of watercraft which does not rely on a low center of gravity for stability, is easy to maneuver, and which moves through water with minimal resistance. An object of the invention is an agile watercraft with an active and intuitive method of maintaining balance.

FIELD OF CLASSIFICATION

| | |
|---|---|
| CPC | B63H 16/14<br>B63B 2001/045; B63B 1/14; B60F3/0084; B60F 3/00; B63H 21/175; B63B 35/73; B63H 5/125; B63H 16/20; B63B 35/77; |
| IPC | B63H 16/20; B63H 25/06; B63H 16/18; B63B 7/00 |
| USPC | 440/30; 440/12; 440/12.5; 440/12.58; 114/61.19 |

REFERENCES CITED

| | | |
|---|---|---|
| 577,269 | 1896 Sep. 4 | Powvley, A. |
| 615,871 | 1897 Nov. 29 | Muller, R. |
| 642,683 | 1899 May 12 | Erickson, J. |
| 691,805 | 1901 Feb. 16 | Perry, S. |
| 799,667 | 1904 Aug. 18 | Payette, Z. |
| 801,071 | 1904 Oct. 25 | Fowler, E. |
| 1,034,278 | 1912 Mar. 3 | Munsen, H. |
| 1,126,037 | 1914 Aug. 24 | Lehotsky, J. |
| 3,139,058 | 1963 Feb. 5 | Robinson, R. |
| 3,410,244 | 1966 Feb. 18 | Graham, V. |
| 3,483,844 | 1967 Dec. 18 | Trautwein, W. |
| 3,640,239 | 1970 May 27 | Petroskey, P. |
| 3,982,495 | 1975 Jun. 9 | Hill, G. |
| 4,170,188 | 1977 Jun. 22 | Jamison, J. |
| 4,285,674 | 1979 Jun. 7 | Chew, T. |
| 4,459,116 | 1981 Nov. 5 | Moore, G. |
| 4,559,892 | 1983 Oct. 14 | Cascallana, R. |
| 4,698,034 | 1985 Jul. 10 | Anthonijsz, E. |
| 4,789,365 | 1987 Apr. 20 | Jones, J. |
| 5,224,886 | 1992 May 18 | Cunningham, B. |
| 5,413,066 | 1994 Jun. 2 | Spencer, W. |

-continued

| | | |
|---|---|---|
| 5,547,406 | 1995 Jul. 6 | White, R. |
| 6,309,263 | 2000 Jun. 22 | Meir-Maza, R. |
| 7,931,512 | 2009 May 22 | Bortsov, P. |
| 9,061,557 | 2013 Apr. 20 | Garrett, P. |
| 9,302,755 | 2014 Nov. 21 | Wolfe, B. |
| 9,650,109 | 2015 Dec. 23 | Schiller, J. |

BRIEF SUMMARY OF THE INVENTION

The invention provides an apparatus for water transport, recreation, exercise and sport which is responsive and easy to maneuver. It is herein referred to as a watercraft. The watercraft comprises two or more flotation elements aligned fore and aft, a fore flotation element capable of pivoting about an axis. Adjacent ends of the flotation elements fit together to minimize turbulence and water resistance. The pivoting steering axis of the fore flotation element is tilted aft of vertical toward the watercraft occupants. Pivotal movements of the fore flotation element shifts the transverse center of gravity to maintain balance. The shape of the front flotation element and the angle of the pivot axis effect the amount of weight shift caused by pivotal movements. Changes in weight distribution caused by movement of the pivot axis alone are maximized when the pivot axis of the watercraft is fixed at 45 degrees to the waterline, which is midway between vertical and horizontal. Watercraft use, design and speed are factors which determine the amount of weight shift affect which is desirable, and the pivot axis is therefore set at different angles relative to the waterline in various embodiments of the invention.

In a preferred embodiment, the watercraft is ridden in a manner similar to riding a bicycle. Riders who are positioned principally above the gunwales of the watercraft can easily maintain balance. When the fore flotation element of the watercraft is turned to the right or left, weight is shifted laterally to the opposite side of the watercraft due to the shape of the fore flotation element and the angle at which it pivots. When the watercraft tilts to either side, a rider is able to avoid tipping over by turning the bow of the watercraft in the same direction that the watercraft is tilting, thereby shifting the transverse center of gravity back toward the center of the watercraft to counter the tipping motion. Balancing in this manner feels familiar to anyone who is proficient at riding a bicycle and it is therefore easy for operators of the watercraft to accomplish. Balance can be easily maintained by the rider when the watercraft is stationary as well as when the watercraft is in motion by making quick steering adjustments.

In a preferred embodiment, a front rudder projects from the longitudinal center line of the bottom of the fore flotation element. The rudder is rigidly connected to the fore flotation element and the rudder turns with the fore flotation element. The rudder is positioned proximal to the pivotal axis of the fore flotation element which allows for easy and effective steering. A portion of the rudder blade is optionally located aft of the center of said axis. When turning, this counters an initial opposing motion caused by a sweeping movement of the watercraft bow. The position of the rudder also assists the operator when steering the watercraft in a predominately straight path.

Quick, responsive turns of the watercraft can be performed using the pivotal fore flotation element and connected rudder. In a preferred embodiment, depth of the rudder blade is manually adjustable and a latch connected to a cable can be operated by the watercraft operator to release the rudder if desired when shallow water is encountered and when the watercraft is brought to shore. The rudder is removable for transport.

In a preferred embodiment, a propeller is rotatably connected to an out drive unit which includes a plurality of pulleys, bearings and a drive belt. The out drive unit is attached to the aft end of the watercraft and optionally capable of pivoting in and out of the water when landing on shore, or otherwise desired. The out drive unit is rotatably connected to a drivetrain by a sprocket. The drivetrain provides locomotion. In this embodiment, the watercraft is manually powered by foot pedals rotatably connected to crank arms on the drivetrain. The drivetrain comprises a plurality of sprockets, roller chains, bearings and axles rotatably connected to a bicycle frame, or a plastic and fiber composite or metal frame of similar construction.

BRIEF DESCRIPTION OF THE DRAWINGS

The included drawings show ways to accomplish the invention, but the scope of the invention is not limited by the illustrations.

DETAILED DESCRIPTION OF THE INVENTION

Figure 1:
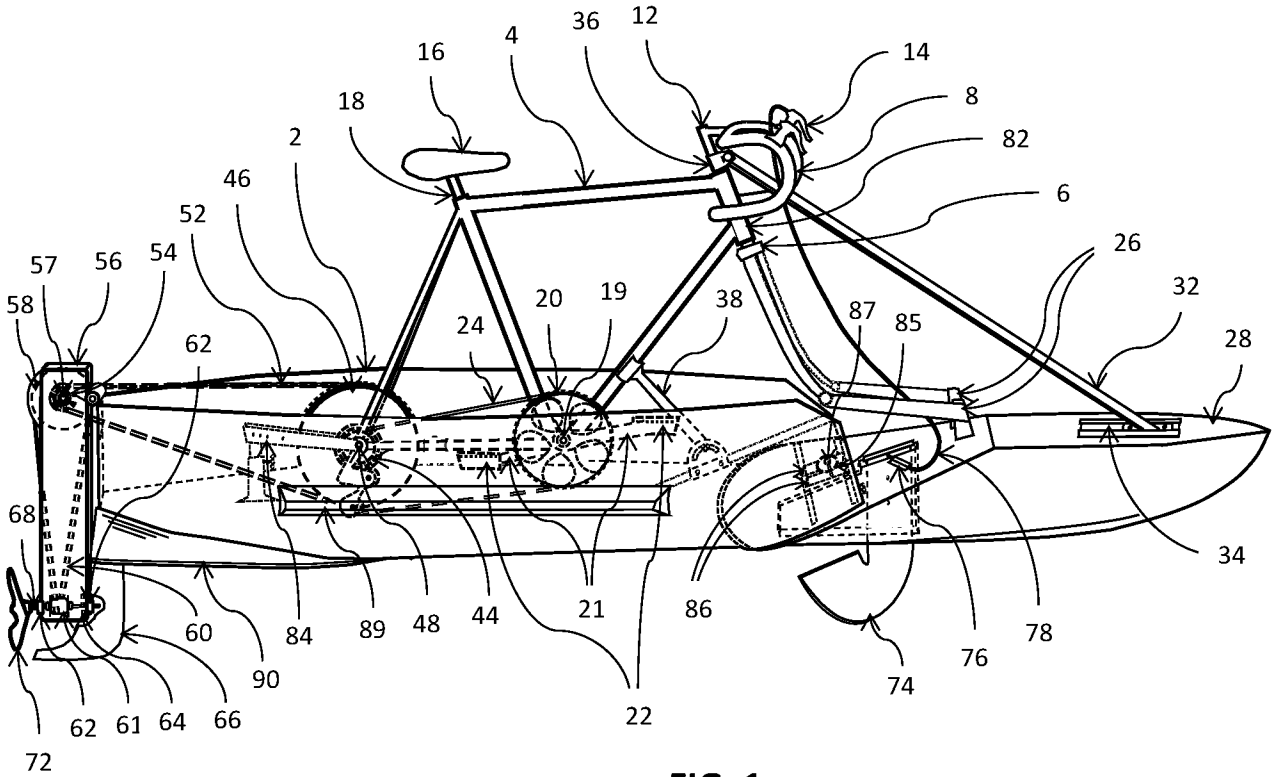
FIG. 1 is a side perspective view of a preferred embodiment wherein the angle of curvature of matching adjacent surfaces between flotation elements is zero and said matching adjacent surfaces are flat.

In a preferred embodiment illustrated in FIG. 1, the invention includes a main flotation element 2 to which a conventional bicycle frame 4 is adjustably attached. The main flotation element 2 is constructed of plastic, or plastic and fiber composite materials, with optional metal reinforcement. A bicycle fork assembly 6 is pivotally attached to the bicycle frame 4. A handlebar 8 with an attached stem riser 12 and a latch release control handle 14 are adjustably attached to the fork assembly 6. A seat 16 and seat post 18 are adjustably attached to the bicycle frame 4.

The fork assembly 6 is rigidly attached to adjustable brackets 26 on a fore flotation element 28 which is located forward of the main flotation element 2. The fore flotation element 28 is constructed of plastic, or plastic and fiber composite materials, with optional metal reinforcement. The lower end of a support 32 is adjustably attached to a surface bracket 34 mounted on the top deck of the fore flotation element 28. The upper end of the support 32 is removably attached to a bracket 36 mounted on the handlebar stem riser 12. The bicycle frame 4 is supported by an adjustable brace 38 that is attached to the main flotation element 2.

The functional shape of the combined hull of the watercraft changes whenever the fore flotation element 28 is rotated out of linear alignment with the main flotation element 2, thereby tilting the watercraft toward the outside of each turn. The term combined hull herein refers to the combined lower exterior portions of flotation elements which form the buoyant body of the watercraft.

The shape of the aft end of the fore flotation element 28 matches the shape of the adjacent end of the main flotation element 2, forming a pivotal joint. In a preferred embodiment illustrated in FIG. 1, the matching adjacent ends of the fore flotation element 28 and the main flotation element 2 are perpendicular to the pivotal steering axis and the angle of curvature of each matching surface is zero. These matching surfaces are essentially flat. Alternate embodiments of the watercraft with alternate joint shapes are illustrated in FIGS. 4 through 7.

In FIG. 1, two crank arms 21 are rigidly attached to an axle 19 which is rotatably attached to the bicycle frame 4. A chainring 20 is rigidly attached to the crank arms 21. Pedals 22 are rotatably attached to the crank arms 21. A bicycle chain 24 is mounted around the chainring 20 and a sprocket set 44. A large single sprocket 46 is rigidly attached to the sprocket set 44 and rotatably attached to an axle 48 which is rigidly mounted on the rear fork ends of the bicycle frame 4. A roller chain 52 extends around the large sprocket 46 and a rear sprocket 54 which is attached to an out drive unit 56. The out drive unit 56 comprises a casing made of metal, plastic or composite materials housing an upper rotatable shaft 57 to which the rear sprocket 54 and an upper pulley 58 are rigidly attached. A drive belt 60 which is twisted ninety degrees extends around the upper pulley 58 and a lower pulley 61. The lower pulley 61 is rigidly attached to a rotatable propeller shaft 68. A propeller 72 is rigidly and removably connected to the propeller shaft 68. The upper shaft 57 and propeller shaft 68 are mounted on a plurality of waterproof or watertight radial bearings 62. One or more waterproof thrust bearings 64 are mounted on the propeller shaft 68. The out drive unit 56 is pivotally attached to the upper portion of the stern of the watercraft so that it may be raised when desired. A skeg 66 is rigidly attached to the lower front of the out drive unit 56.

A front rudder 74 extends through a slotted opening in the bottom of the fore flotation element 28. Watertight inner walls separate the slotted opening from the inner cavity of the fore flotation element 28. The rudder 74 is proximal to the pivot axis of the fore flotation element 28 to minimize turning resistance. The rudder 74 combined with the pivotal fore flotation element 28 is capable of executing quick changes in direction. The ability to make responsive directional changes improves recreational enjoyment and ease of operation.

A portion of the blade of the rudder 74 is located aft of the steering pivot axis to improve tracking and counter an initial opposing force when turning. Turning the submerged portion of the bow section of the watercraft would otherwise initially push the watercraft in the opposite direction of the turn. The location of the rudder 74 makes for smooth turns and intuitive steering.

A rudder latch bolt release 76 is connected to the latch release control handle 14 by a cable line 78.

A head tube 82 is an integral part of the conventional bicycle frame 4. The fork assembly 6 is pivotally connected to the head tube 82. Conventional bicycle frames are commonly manufactured in a range of sizes and with the top of the head tube tilted aft of vertical at different angles for different uses. To accommodate varying bicycle frame sizes and design, rear mounting brackets 84 which are rigidly attached to the main flotation element 2 and adjustably attached to the rear fork ends of the bicycle frame 4 may be adjusted, the adjustable brackets 26 on the fore flotation element 28 may be adjusted, the adjustable support 32 may be moved in the adjustment plate 34, and the brace 38 may be moved up or down. The angle of the head tube 82 relative to the watercraft can be adjusted to the appropriate steering axis angle for the watercraft by raising or lowering the aft end of the bicycle frame 4 on the rear mounting brackets 84.

The main flotation element 2 and the fore flotation element 28 are optionally and detachably connected together by an adjustable swivel coupling 85. The swivel coupling 85 in a preferred embodiment shown in FIG. 1 comprises a round metal plate which is adjustably mounted on rails 86. The rails 86 are rigidly attached to the main flotation element 2. A machine bolt 87 is adjustably attached on the lower end to the fore flotation element 28 and removably attached on the upper end through the round metal plate of swivel coupling 85, thereby connecting said flotation elements together. The swivel coupling 85 is positioned in line with the pivotal steering axis of the fore flotation element 28, and reduces load on bearings in the head tube 82. A watertight metal or plastic curbing, 88 illustrated in FIG. 2, surrounds the swivel coupling 85.

Removable, buoyant plastic segments 89 are attached horizontally on each exterior lateral side of the main flotation element at the approximate waterline. The plastic segments 89 provide additional buoyancy when the normal waterline is exceeded on either side or both sides of the watercraft.

A horizontal plate 90 is optionally and rigidly attached to the bottom of the main flotation element 2 proximal to the stern. The horizontal plate 90 is wider than the remainder of the aft portion of the hull below waterline. The horizontal plate 90 increases hydrodynamic lift as speed increases without significantly increasing hydraulic resistance. At slower speeds lift is derived primarily by water displacement.

Figure 2:
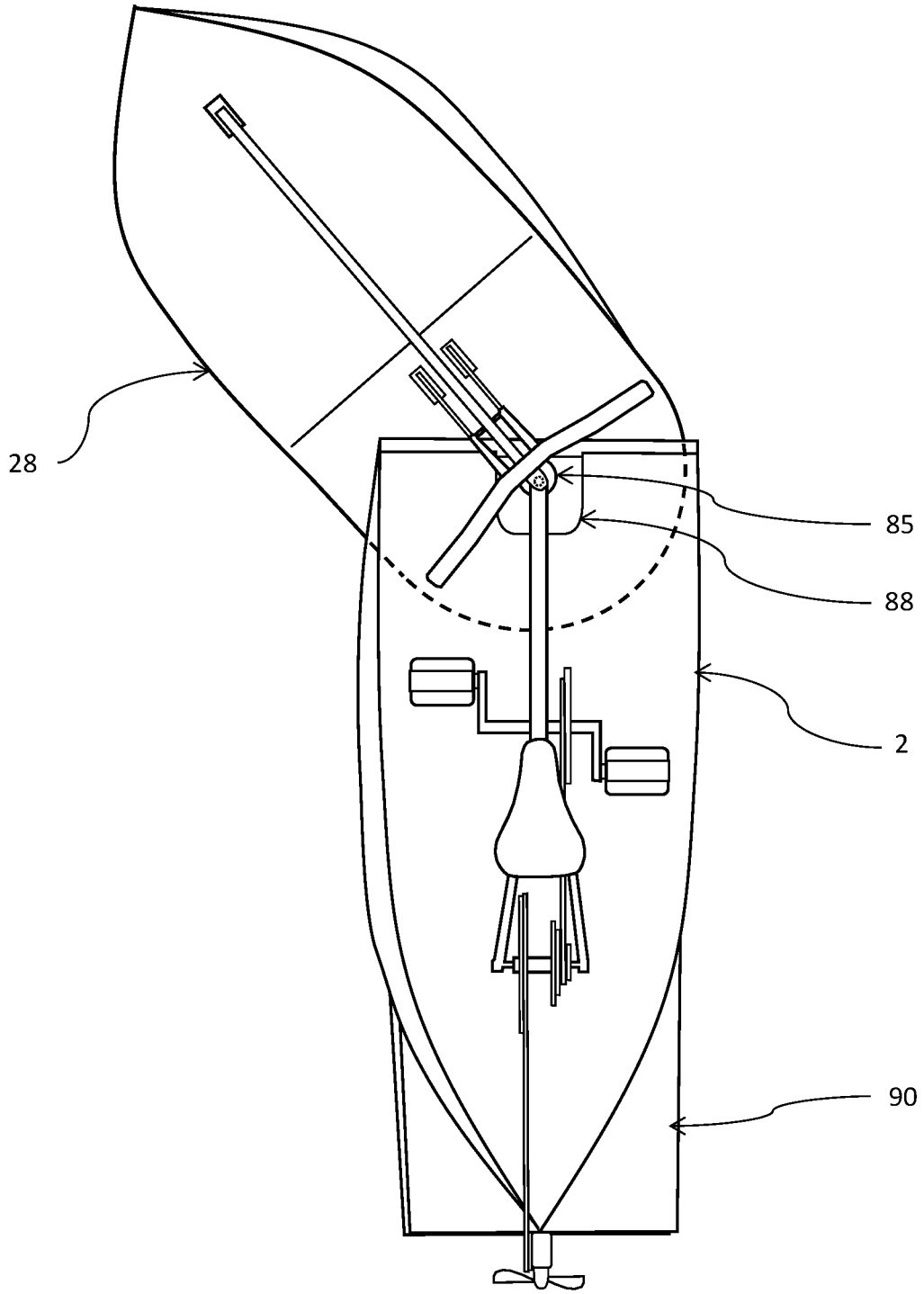
FIG. 2 is a top plan view of the preferred embodiment. The fore flotation element is turned to the left.
Figure 3:
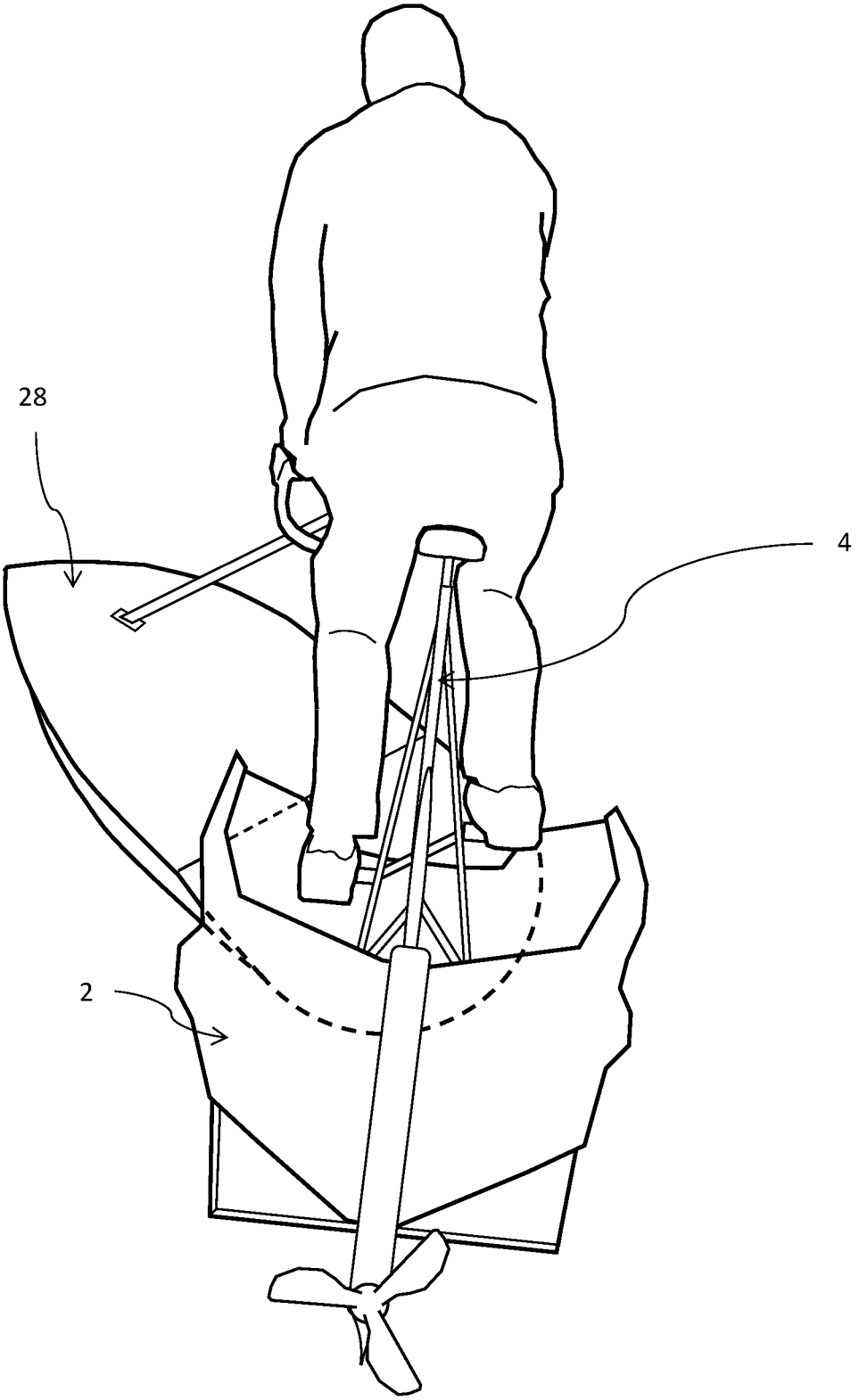
FIG. 3 is a back side perspective view of the preferred embodiment with the fore flotation element turned to the left.

As illustrated in FIG. 2, when the fore flotation element 28 is turned out of linear alignment with the main flotation element 2, the shape of the combined hull is changed. As illustrated in FIG. 3, the shape of the fore flotation element 28 and the angle at which it pivots cause the point of the bow of the fore flotation element 28 to move toward the waterline as the fore flotation element 28 pivots out of alignment with the main flotation element 2. Weight is thereby redistributed, shifting the transverse center of gravity away from the direction of each turn. A watercraft operator can use shifts in weight distribution through left and right corrective pivots of the fore flotation element 28 to maintain upright stability. The watercraft can be balanced in this manner when the watercraft is otherwise stationary in water and when moving through water.

When climbing aboard the watercraft from a body of water, the operator can stabilize the watercraft by fully rotating the bow of the fore flotation element 28 in the direction of the operator, which increases the lateral dimension of the hull and tilts the watercraft away from the operator, thereby counter balancing the weight of the operator while boarding.

As illustrated in FIG. 1, the exterior hull of the fore flotation element 28 is semicircular where it meets the semicircular matching end of the main flotation element 2. The steering pivot axis is positioned at the center of the diameter of the semicircle. Consequently, as the fore flotation element 28 is rotated during turns, the hull curvature of the aft end of the fore flotation element 28 continues to match the curvature of the hull of the adjacent end of the main flotation element 2 below waterline, which minimizes resistance to water flow.

In an alternate embodiment, the support 32 is replaced with a plurality of adjustable supports, and the adjustable surface bracket 34 is replaced with a plurality of surface brackets.

In an alternate embodiment, the roller chain 52 is replaced by a belt, the large sprocket 46 is replaced by a pulley, and the rear sprocket 54 is replaced by a pulley.

In an alternate embodiment, a rear bicycle wheel replaces the large sprocket 46. In this embodiment, the roller chain 52 and the rear sprocket 54 are replaced by rollers.

In an alternate embodiment, the upper pulley 58 and the lower pulley 61 are replaced by sprockets, and the belt 60 is replaced by a roller chain.

In an alternate embodiment, the upper pulley 58, the lower pulley 61 and the belt 60 are replaced by a gear box with bevel gears.

In an alternate embodiment, the optional swivel coupling 85 between flotation elements comprises a ball and socket similar to a tow hitch coupler.

In an alternate embodiment, a motor replaces the manual drivetrain.

In an alternate embodiment, the bicycle frame 4 is replaced by a similar framework of metal, carbon, plastic or composite structural materials rigidly attached to the main flotation element 2, and the fork assembly 6 is replaced by a metal, plastic or composite structural member or members pivotally attached to the frame 4 and rigidly attached to the fore flotation element 28.

In an alternate embodiment, the upright bicycle frame 4 is replaced by a framework similar to a recumbent bicycle frame.

In an alternate embodiment, the front rudder 74 is hinged.

In an alternate embodiment, the front rudder 74 is replaced by a keel or bottom fin.

In an alternate embodiment, the front rudder 74 is replaced by a plurality of longitudinal bottom fins.

Figure 4:
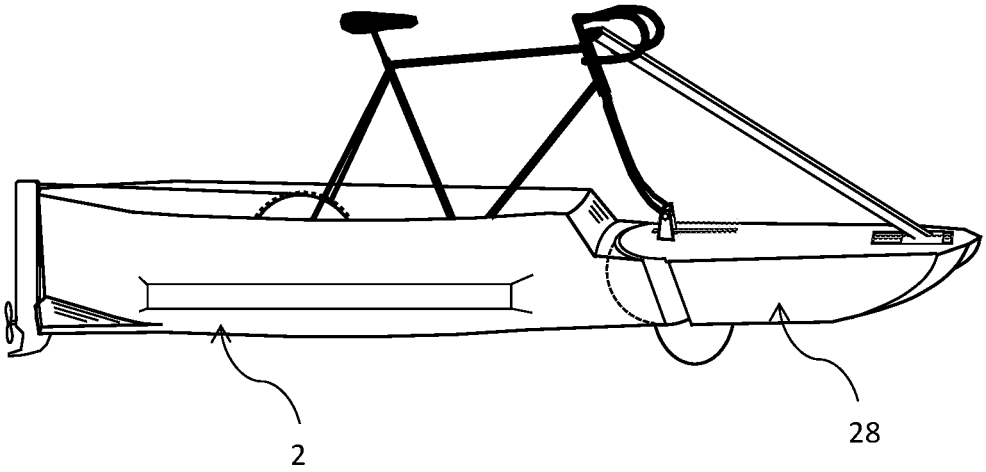
FIG. 4 is a side view of an alternate embodiment characterized by a spherically shaped pivot joint between fore and aft flotation elements.

In an alternate embodiment illustrated in FIG. 4, the shape of the aft end of the fore flotation element 28 is both a horizontal and vertical convex arc of a circle. The radius of each circle is essentially equal to the distance from the center point of the pivotal axis of the fore flotation element to the aft end of said flotation element. The shape of the fore end of the adjacent flotation element 2 is a concave horizontal and vertical symmetrical arc of a circle essentially matching the aft end of the fore flotation element, creating a pivotal joint similar in appearance to a ball and socket.

Figure 5:
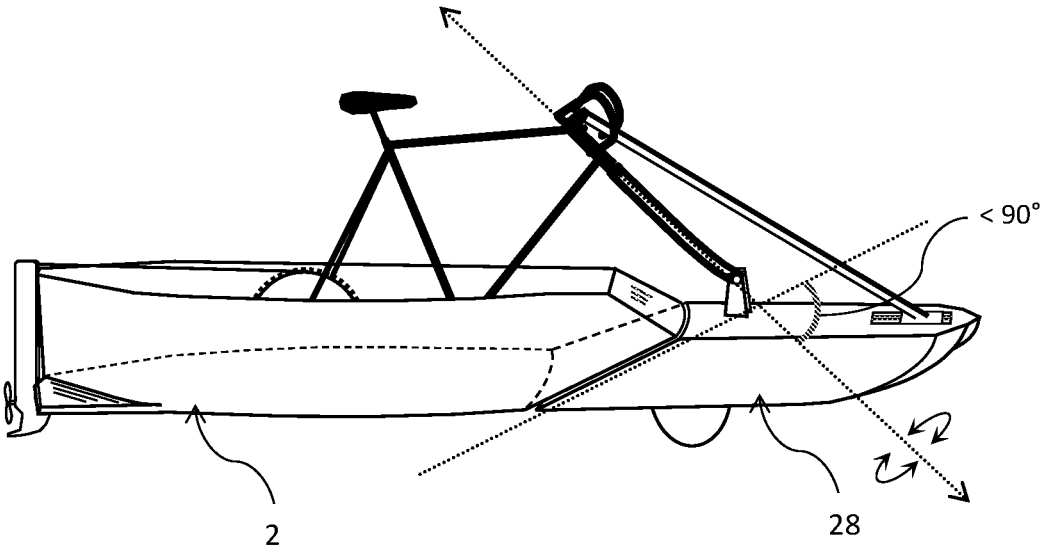
FIG. 5 is aside perspective view of an alternate embodiment wherein the angle of a pivotal steering axis of a fore flotation element is less than ninety degrees to the plane of a joint between the fore flotation element and an adjacent flotation element.

In an alternate embodiment illustrated in FIG. 5, the joint formed by matching surfaces on the aft end of the fore flotation element 28 and the fore end of an adjacent flotation element 2 is less than 90 degrees relative to the pivotal steering axis. The surface of the aft end of the fore flotation element 28 includes a primary curvature which is concave. The matching surface of the fore end of an adjacent main flotation element 2 includes a primary curvature which is convex.

Figure 6:
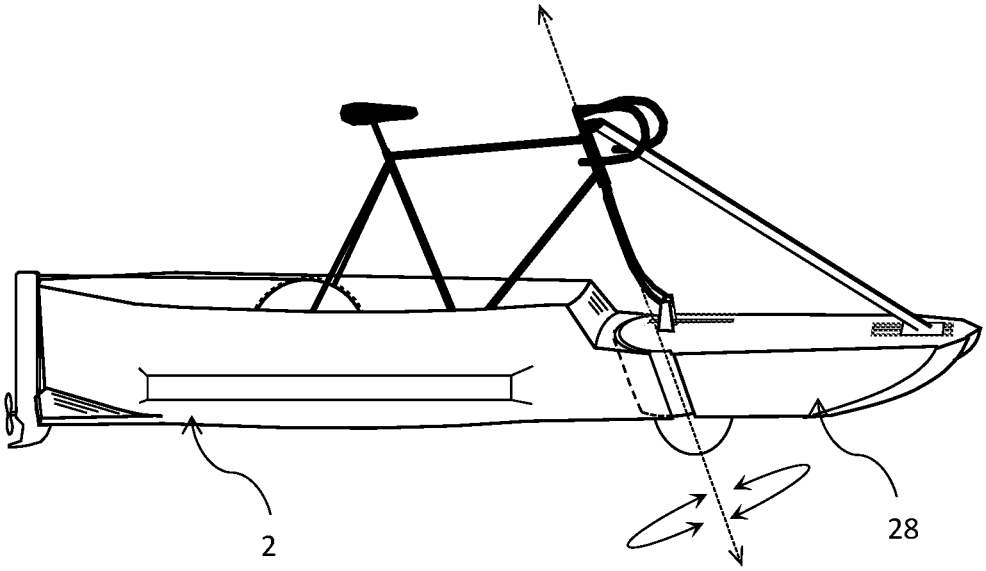
FIG. 6 is aside view of an alternate embodiment wherein the joint between fore and aft flotation elements has a cylindrical shape.

In an alternate embodiment illustrated in FIG. 6, a joint between the fore flotation element 28 and an aft flotation element 2 is cylindrical.

Figure 7:
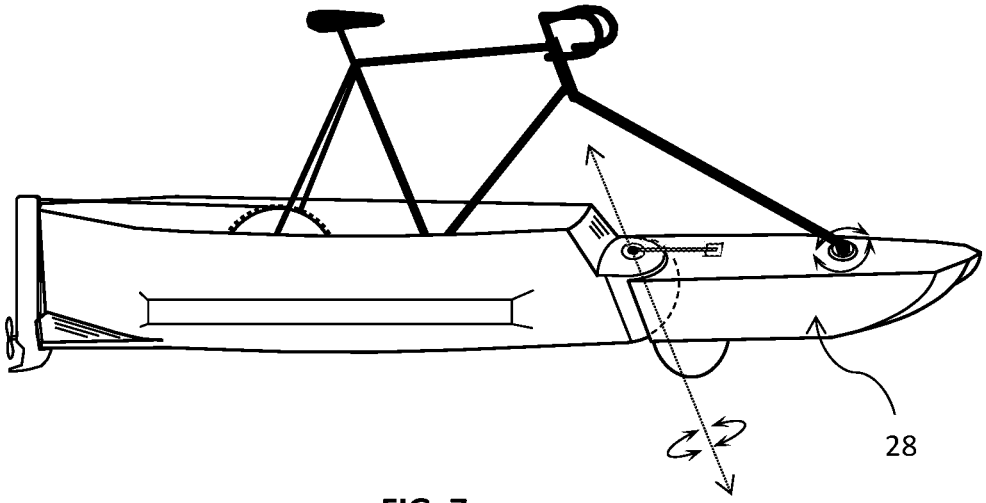
FIG. 7 is a side view of an alternate embodiment characterized by a forward pivotal connection point on a fore flotation element.

In an alternate embodiment illustrated in FIG. 7, the attachment point of the steering mechanism on a fore flotation element 28 is moved forward and attached at a rotational connecting point.

The scope of use for pivot joints formed by matching surfaces on adjacent flotation elements includes other types of watercraft beyond the watercraft described herein and said joints formed by matching surfaces on adjacent flotation elements may be used in combination.

In an alternate embodiment, the buoyant plastic segments 89 are integral to the hull, comprising a widening of the hull of the main flotation element 2 on each side immediately above and along the approximate water line.

In an alternate embodiment, the horizontal plate 90 is removable.

In an alternate embodiment, the chainring 20 is elliptical.

In an alternate embodiment, the large sprocket 46 is elliptical.

Optional changes may be made to the shape of the combined hull, the shape of flotation elements, the number of flotation elements, and the angle of the steering axis without altering the nature of the invention. Changes in hull length and profile may be made depending upon use and performance preferences without departing from the scope of the invention.

We claim:

1. A watercraft, comprising:

a first flotation element and a second flotation element arranged linearly; the first flotation element pivotal about a steering axis; the aft end of the first flotation element oblique and pivotally mounted under an oblique fore end of the second flotation element; adjoining ends of the flotation elements characterized by matching contours shapes; the contour shape on the fore end of the second flotation element overlying and pivotally connected to the matching contour shape on the aft end of the first flotation element; the entire surface areas of adjoining ends of the flotation elements essentially in contact or with negligible clearance between the surfaces; the proximity of said matching contour surfaces on the adjoining ends of the flotation elements remaining constant throughout a 45 degree turn of the first flotation element; the axis of rotation aft of vertical.

2. The watercraft of claim 1, wherein the pivot connection between the adjoining flotation elements comprises a cylinder projecting from the oblique aft end of the first flotation element pivotally attached to a ring fixed to the overlying matching oblique fore end of the second flotation element; the matching contours on adjoining ends of the flotation elements essentially flat and said oblique end of the first flotation element at an acute angle to the keel line of the watercraft; the matching adjoining ends of said flotation elements semicircular below waterline with equal diameters; the pivot connection located at the center of the diameter of the semicircular surfaces and the edges of the perimeters of the adjoining ends uniformly matching below waterline waterline as the first flotation element pivots.

3. A watercraft, comprising;

a framework with adjustably attached seat post and seat; and adjustably attached handlebar riser and handlebars; the framework capable of carrying a rider in a position similar to a rider on a bicycle; and the framework attached to and supported by a plurality of collinear flotation elements; a portion of the framework located in the hull of an aft flotation element; and a fore flotation element capable of pivoting about an axis to steer the watercraft; and a rudder projecting from the bottom of the fore flotation element along the longitudinal center line of said fore flotation element; the rudder pivoting with the fore flotation element; and a drivetrain located in and above the aft flotation element; and a propeller shaft rotatably attached at the stern of the watercraft; and a propeller removably attached to the propeller shaft; and the propeller shaft turned by said drivetrain.

4. The watercraft of claim 3; the rudder proximal to said pivot axis, wherein a portion of the rudder is located aft of said axis, thereby improving steering performance.

5. The watercraft of claim 3; the outer hulls of said flotation elements comprising plastic or plastic and fiber composite materials; and said framework comprising a bicycle frame and component parts adjustably attached to the flotation elements; the bicycle fork adjustably attached to the fore flotation element and pivotally connected to the remainder of the bicycle frame; the pivot axis of said bicycle fork set at an angle to the waterline whereby the front bow point of the fore flotation element moves downward In the direction of the waterline when the bow is pivoted toward either side of the watercraft; thereby shifting weight distribution laterally; said pivot motions usable by the watercraft operator to maintain balance.

6. A manually powered watercraft, comprising:

a plurality of flotation elements aligned longitudinally;

a main flotation element with an attached framework capable of supporting one or more occupants; and a drivetrain with foot pedals rotatably connected to the framework; and an out drive unit pivotally attached to the stern of the watercraft and rotatably connected to the drivetrain; and a propeller shaft rotatably attached to the lower portion of the out drive unit; and a propeller rigidly and removably attached to the propeller shaft; and a fore flotation element pivotal about an axis for steering the watercraft; and said pivotal steering axis tilted aft of vertical toward the watercraft occupants, whereby pivotal movements of the fore flotation element shift transverse weight distribution; and said weight shifts capable of moving the center of gravity of the watercraft sufficiently to maintain balance.

7. The watercraft of claim 6, the aft section of said main flotation element tapered in the shape of a common displacement hull stern, thereby reducing drag; and said stern including a horizontal projection at the bottom; the projection wider than the remainder of the stern; thereby increasing hydrodynamic lift as the speed of the watercraft increases.

8. The watercraft of claim 6, said drivetrain including two crank arms rigidly attached to sprockets and an axle; the axle rotatably attached to the framework; and the sprockets rotatably connected to said out drive unit at the watercraft stern; and the out drive unit including a plurality of pulleys; a plurality of bearings; a propeller shaft and a drive belt; the drive belt twisted ninety degrees; thereby changing the direction of rotation of the drivetrain to spin the propeller shaft; the propeller connected to the aft end of the propeller shaft.

* * * * *